US005361869A

United States Patent [19]

Ledbetter

[11] Patent Number: 5,361,869

[45] Date of Patent: Nov. 8, 1994

[54] HAND CLIMBER

[76] Inventor: Elmer W. Ledbetter, Rte. 1, Box 145, Jamestown, Tenn. 38556

[21] Appl. No.: 134,627

[22] Filed: Oct. 12, 1993

[51] Int. Cl.[5] ..... A63B 27/00

[52] U.S. Cl. ..... 182/133; 182/92

[58] Field of Search ..... 182/133–136, 182/90–92, 187

[56] References Cited

U.S. PATENT DOCUMENTS 2,808,975 10/1957 Palmquist ..... 182/120 X
3,598,201 8/1971 Thurmond ..... 182/187 X
4,620,616 11/1986 Southard ..... 248/293 X
4,669,575 6/1987 Skyba ..... 182/92

*Primary Examiner*—Alvin C. Chin-Shue

[57] ABSTRACT

A hand climber is disclosed which aids a person in scaling a tree without damage to the tree. The hand climber includes a chain for extending around the tree, a top anchor for securing the chain around the tree and a body anchor for securing the hand climber to the tree. Attached at one side to the body anchor is a fold out handle use by a climber to grip the device. Sets of teeth are attached to the opposite side of the body anchor to secure the device to the tree.

3 Claims, 4 Drawing Sheets

HAND CLIMBER

BACKGROUND OF THE INVENTION

1. Field of the Invention

The present invention relates generally to a climbing aid, and more particularly, to a device to aid a climber in climbing trees.

2. Description of the Prior Art

Devices for aiding a person in scaling obstacles are generally well known. For example, U.S. Pat. No. 3,944,022 dated March 16, 1976 discloses a tree-climbing platform having a rigid stand and tubular runners. Similarly, U.S. Pat. No. 5,090,505 dated Feb. 25, 1992 discloses a tree climbing stand utilizing two climbing elements and a spring element. U.S. Pat. No. 3,955,645 dated May 11, 1976 discloses a hand held climbing device which is shimmied up a tree and pivoted downwardly until it grips the tree. This device also includes a standing platform operated in a similar manner. U.S. Pat. No. 4,987,972 dated Jan. 29, 1991 discloses a climbing tree stand including two separate climbing assemblies. Finally, U.S. Pat. No. 4,417,645 dated Nov. 29, 1983 discloses a portable tree climbing device comprising two assemblies, each having a steel tubular frame with telescoping arms cooperatively encircling the tree.

A need exists, though, for a lightweight, sturdy, small and easy to use device to aid hunters and tree climbers alike in scaling trees. A further need exists for such an aid which is environmentally safe, does not damage trees, and is also of a construction including no nuts and bolts which may be lost causing the device to falter.

The foregoing need is met by the present invention as will be made apparent from the following description thereof. Other advantages of the present invention over the prior art also will be rendered evident.

SUMMARY OF THE INVENTION

To achieve the foregoing and other advantages, the present invention, briefly described, provides a hand climber which aids a person in scaling a tree without damage to the tree. The hand climber includes a chain for extending around the tree, a top anchor for securing the chain around the tree and a body anchor for securing the hand climber to the tree. Attached to one side of the body anchor is a fold out handle used by a climber to grip the device. Sets of teeth are attached to the opposite side of the body anchor to secure the device to the tree.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved hand climber which has all of the advantages of the prior art and none of the disadvantages.

It is another object of the present invention to provide a new and improved hand climber which may be easily and efficiently manufactured and marketed.

It is a further objective of the present invention to provide a new and improved hand climber which is of durable and reliable construction.

An even further object of the present invention is to provide a new and improved hand climber which is susceptible of a low cost of manufacture with regard to both materials and labor, and which accordingly is then susceptible of low prices of sale to the consuming public, thereby making such hand climber available to the buying public.

Still yet a further object of the present invention is to provide a new and improved hand climber which is environmentally safe and does not damage trees.

It is still a further object of the present invention to provide a new and useful hand climber which is constructed without nuts and bolts holding the components together, thus providing more reliable operation.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
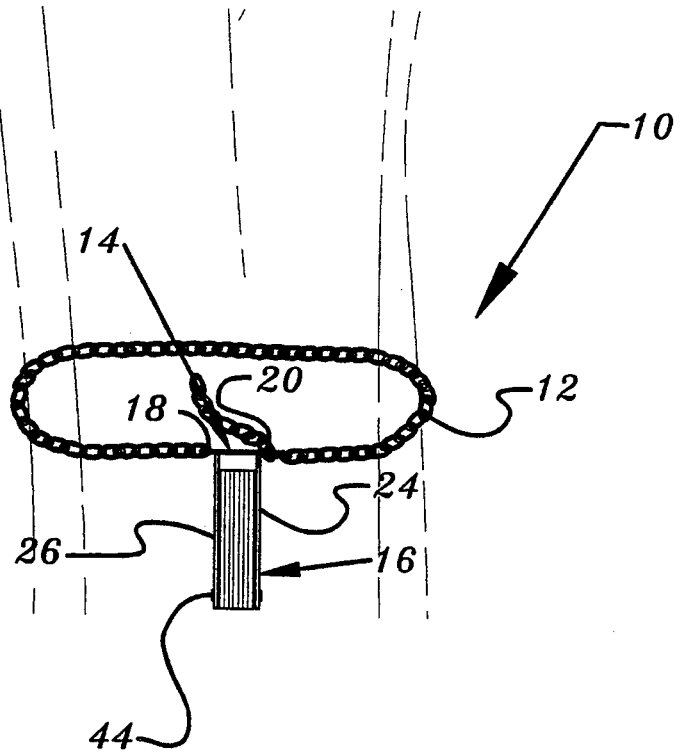
FIG. 1 is an elevational view of the embodiment of the hand climber of the present invention.
Figure 2:
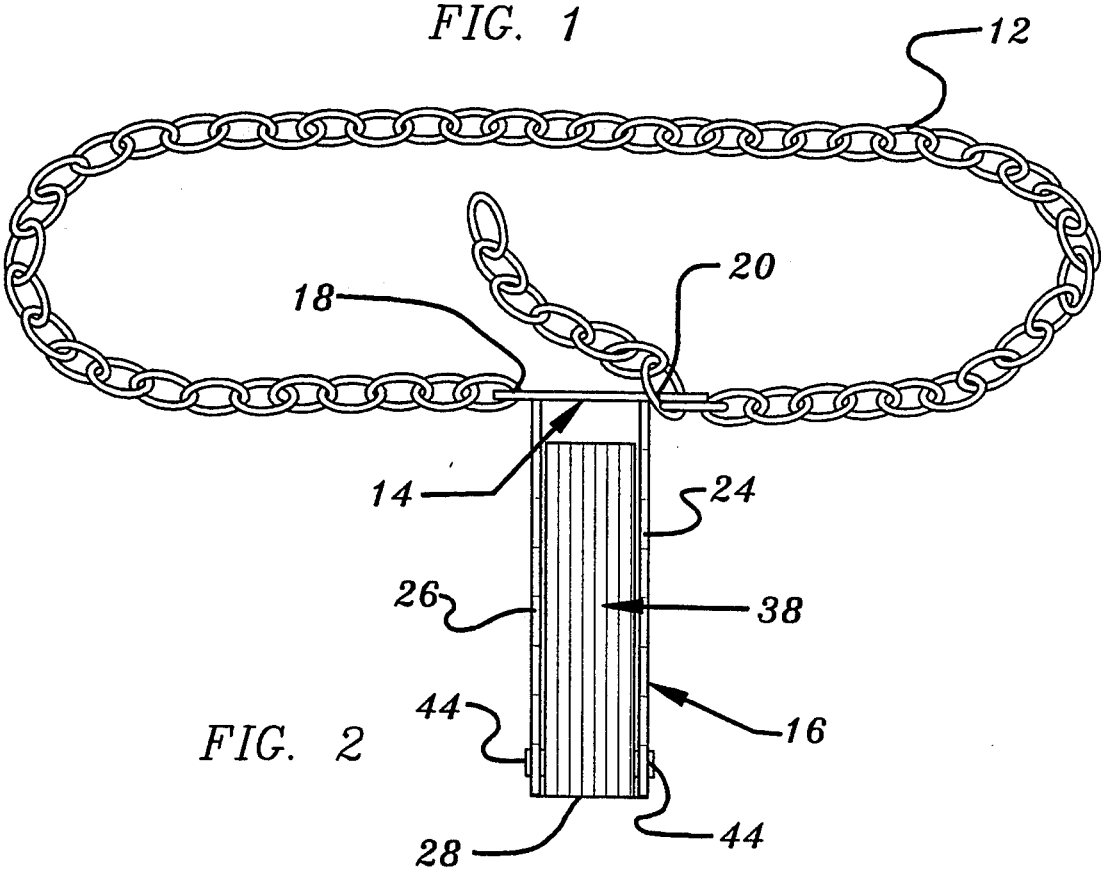
FIG. 2 an enlarged-scale, more detailed view than FIG. 1 of the hand climber of the present invention.

With reference now to the drawings, a new and improved hand climber embodying the principles and concepts of the present invention will be described.

Turning to FIGS. 1–5, there is shown an exemplary embodiment of the hand climber designated by reference numeral 10. In its preferred form, the hand climber 10 comprises generally a chain 12, a top anchor 14 and a body anchor 16. The top anchor 14 includes a hole 18 on a first side of the top anchor 14 and an arcuate-shaped recess 20 on the opposite side of the top anchor 14 cut into and intercepting the front facing edge of the top anchor substantially as depicted. The chain 12 is connected to the top anchor through the hole 18 and its free end selectively may be slid into arcuate recess 20 to enable the chain to form a flexible circumferential connection between the top anchor 14 and a tree, pole or similar article having girth and about which the chain may be fastened in a now apparent manner.

The body anchor 16 includes a rectangularly shaped flat face 22, rectangularly shaped first and second sides, 24 and 26 respectively, and a bottom side 28. Suitably attached to the flat face 22 nearer to top anchor 14 than to bottom side 28 is a flat plate 30 having a central indented surface or recess defining a series of protruding gripper teeth 32 substantially as shown. At the deepest point of extent of the recess in plate 30 is a rectangularly shaped notch 34 which separates the teeth 32 into two laterally spaced sets to facilitate gripping engagement of the teeth with the outer surface on the circumference of a tree, pole or the like.

Figure 3:
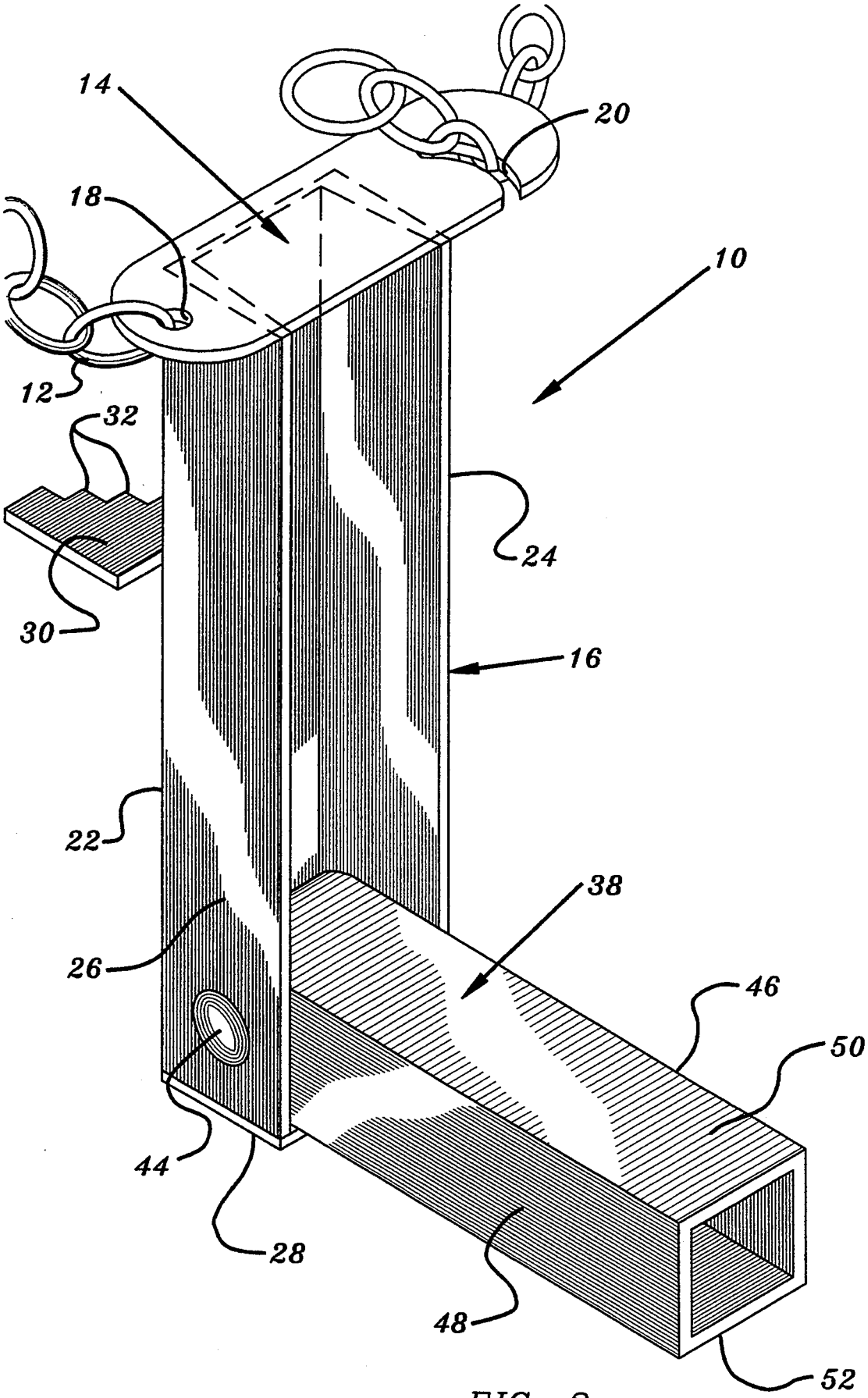
FIG. 3 is a perspective view of the body anchor and handle of the present invention showing the handle in its folded out position.
Figure 4:
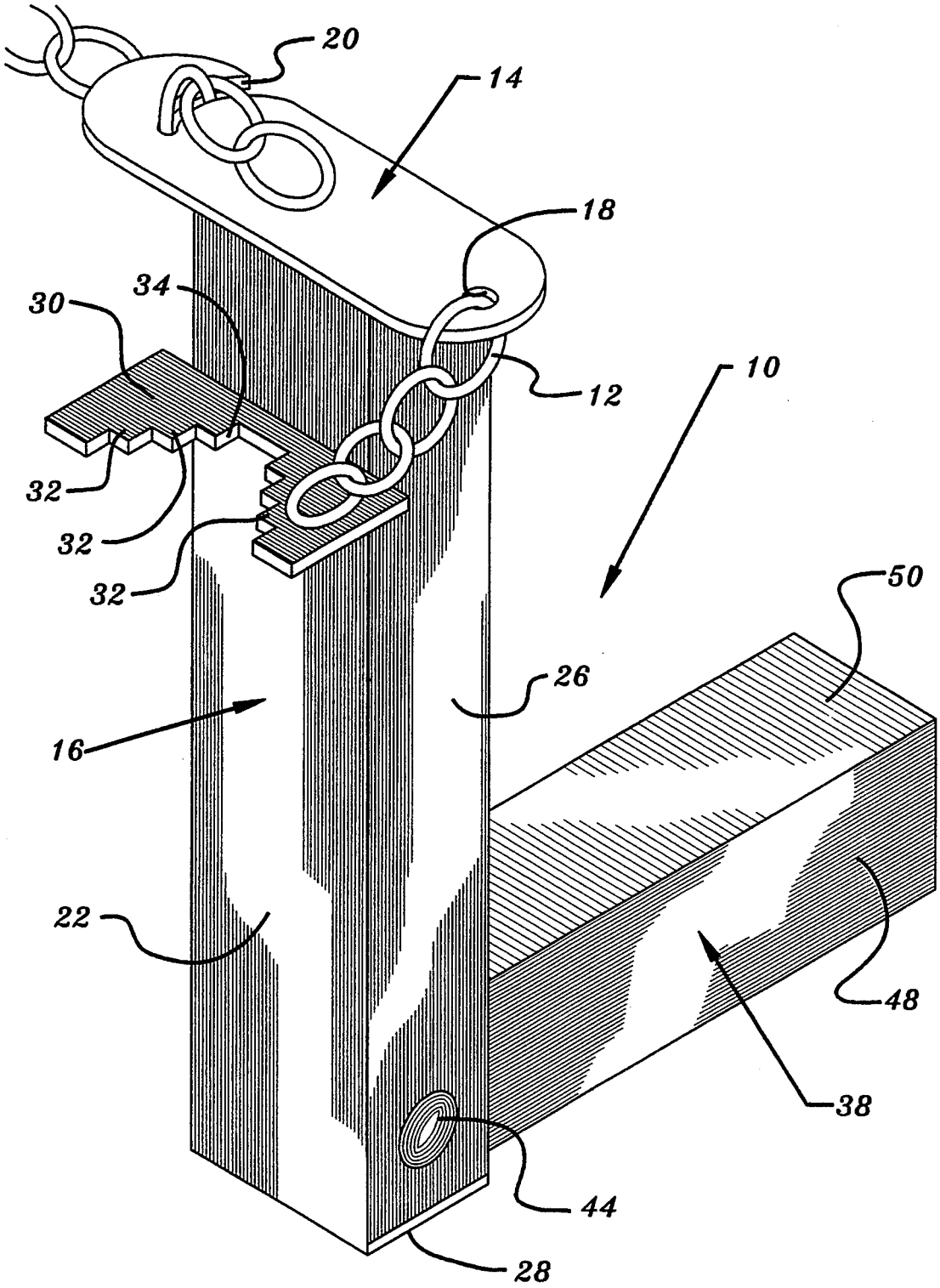
FIG. 4 is a perspective view from the rear of the invention of FIG. 3 more clearly showing the gripping teeth attached to the body anchor.

Attached between the opposed sides 24 and 26 near the bottom thereof is handle 38. The handle 38 is constructed and adapted in such a way as to fold out of the body anchor 16 about an axis passing through a pair of opposed rivets or similar fasteners located in the opposed sides 24, 26 via suitable aligned openings therein (not shown). Optionally, the rivets may be fixed integrally to the opposed ends of an axle extending through the opposed aligned openings in the sidewalls 24, 26 (and in the handle sidewalls as well) and fixed therein by suitable means such as cotter pins, for example. It thus will be appreciated that rivets 44 permit rotation of handle 38 between a first folded position where the handle is nested inside the channel formed by body anchor 16 (FIGS. 1 and 2) and a second or unfolded position where the handle extends orthogonally with respect to the body anchor 16 (FIGS. 3 and 4). Handle 38 has a pair of opposed sides 46, 48; a top 50; and a bottom 52 which is adapted to rest upon the upwardly facing surface of body anchor bottom 28 when the handle is in the second or unfolded position. Handle 38 preferably is hollow as shown to achieve an optimum strength to weight ratio. To enable the handle 38 to easily rotate between its first and second positions as described above, the end of the handle through which suitable aligned openings are provided (not shown) to receive rivets 44 may be rounded off sufficiently so that this end of the handle will clear the bottom side 28 and the upstanding wall 22 of body anchor 16 during folding and unfolding rotation thereof.

Figure 5:
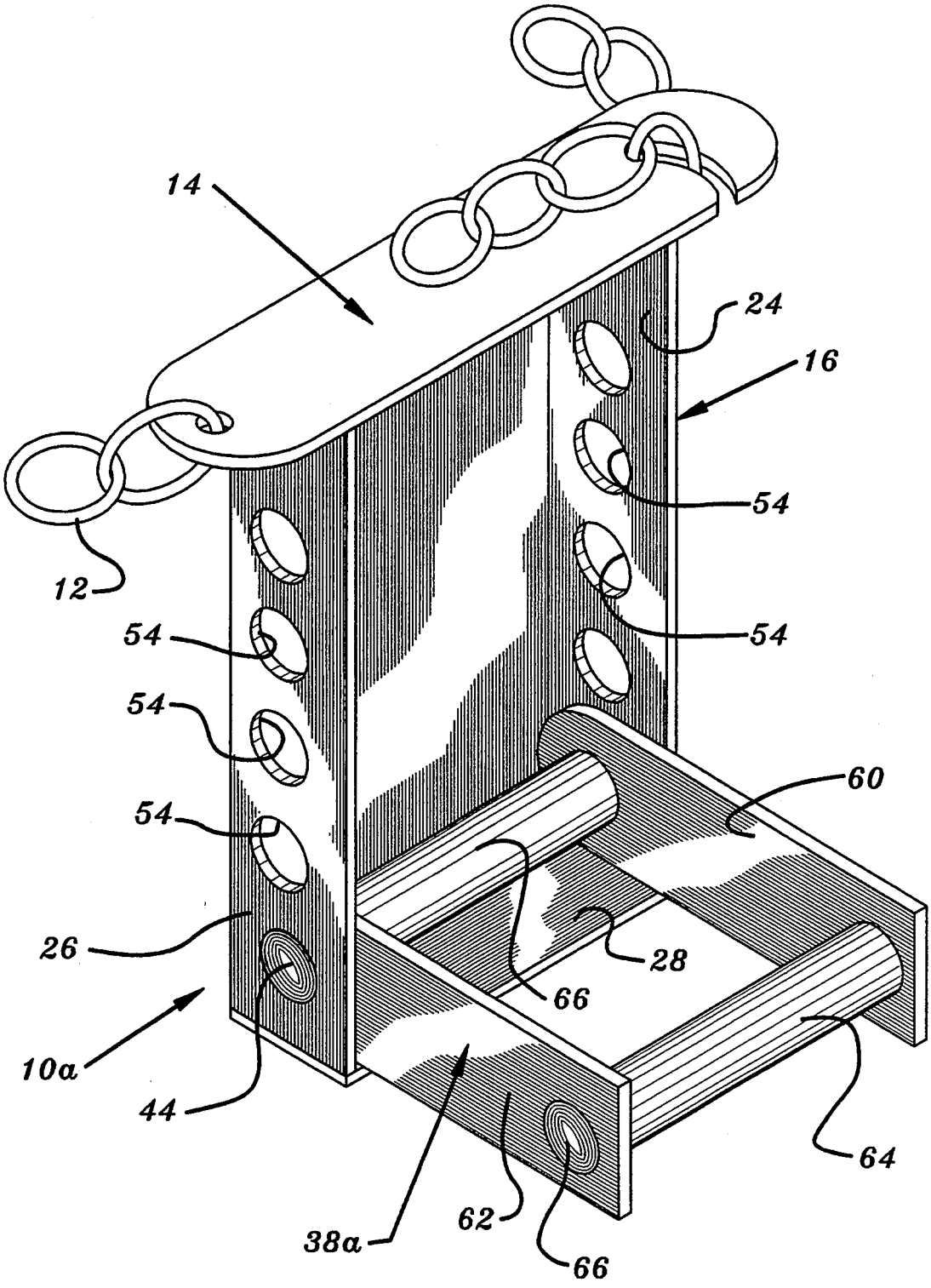
FIG. 5 is a perspective view showing an alternatively preferred embodiment of the invention shown in FIGS. 1 through 4.

Turning now to FIG. 5, there is shown an alternatively preferred embodiment of the invention generally represented by reference numeral **10*a* and wherein like reference numerals are employed to refer to similar parts already described above. Spaced along the opposed sides 24 and 26 are a series of evenly spaced openings 54 which may be used as attachments points for various accessories and which reduce the weight of the unit without sacrificing its strength. Further, in this alternatively preferred embodiment of the invention, handle 38*a* includes opposed sides in the form of flat plates 60 and 62 joined by a pair of spaced tubes 64 and 66. Tubes 64 and 66 may be rigidly attached to the inside surfaces of plates 60 and 62; or loosely fitted on axles (not shown) passing through suitable aligned openings in the opposed plates and captured therein by rivets 44 and 68. The first or outer tube 64 folds out from the body anchor 16** to act as a handle for users.

The hand climber of the present invention preferably is constructed of a high-strength material, preferably steel, with the top anchor being welded to the body anchor. The body anchor preferably is made of a steel channel and the fold out handle is constructed with steel tubing. The teeth on the body anchor are also made of steel.

The purpose of this device is to aid a person in climbing a tree. In operation, the chain is placed around the tree which is desired to be climbed. The chain is then hooked through the recess 20 in the top anchor. When pressure is applied by the climber to the fold out handle, the body anchor presses against the tree and the teeth attach to the tree. The chain is then placed at a higher point around the tree and fastened to the top anchor. Once again pressure is applied to the handle, this time at a higher point on the tree, and the climber moves up the tree. These steps are repeated until the desired height is reached. When using accessory devices such as stirrups, the climbers feet are placed in the stirrups and the same process is followed.

To descend from the tree the process is reversed until the climber reaches the ground.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A hand climber comprising:

a chain having first and second chain ends;

a body anchor having a rectangularly shaped flat face, rectangularly shaped first and second sides, and top and bottom sides, and defining an interior space between said first and second sides thereof;

a top anchor having first and second sides and a perimeter therearound, with a hole extending through said top anchor proximate said first side thereof, and an arcuate-shaped recess extending from said perimeter into said top anchor, said chain being coupled at said first chain end to said top anchor at said hole, with said second chain end being selectively engagable to said arcuate-shaped recess to couple said second chain end to said top anchor about a vertical support pole, thereby securing said top anchor to said vertical support pole, said top anchor being fixedly secured to said top side of said body anchor such that said body anchor hangs downwardly and parallely relative to said vertical support pole;

a flat plate having a central indented recess formed therein, said recess defining a series of protruding gripper teeth terminating in a rectangularly shaped notch which separates said teeth into two laterally spaced sets of teeth, said flat plate being secured to said flat face of said body anchor, with said teeth being operable to engage said vertical support pole to preclude translation of said hand climber along said vertical support pole;

a handle pivotally mounted between said first and second sides of said body anchor such that said handle is pivotable between a first position wherein said handle is stored within said body anchor, and a second position wherein said handle is oriented orthogonal to said body anchor.

2. A hand climber comprising:

a chain having first and second chain ends;

a body anchor having a rectangularly shaped flat face, rectangularly shaped first and second sides, top and bottom sides, and defining an interior space between said first and second sides thereof;

a top anchor having first and second sides and a perimeter therearound, with a hole extending through said top anchor proximate said first side thereof, and an arcuate-shaped recess extending from said perimeter into said top anchor, said chain being coupled at said first chain end to said top anchor at said hole, with said second chain end being selectively engagable to said arcuate-shaped recess to couple said second chain end to said top anchor about a vertical support pole, thereby securing said top anchor to said vertical support pole, said top anchor being fixedly secured to said top side of said body anchor such that said body anchor hangs downwardly and parallely relative to said vertical support pole;

a flat plate having a central indented recess formed therein, said recess defining a series of protruding gripper teeth terminating in a rectangularly shaped notch which separates said teeth into two laterally spaced sets of teeth, said flat plate being secured to said flat face of said body anchor, with said teeth being operable to engage said vertical support pole to preclude translation of said hand climber along said vertical support pole;

a handle pivotally mounted between said first and second sides of said body anchor such that said handle is pivotable between a first position wherein said handle is stored within said body anchor, and a second position wherein said handle is oriented orthogonal to said body anchor;

wherein said body anchor has a series of evenly spaced openings along both said first and second sides thereof, said spaced openings being arranged in opposed pairs and operable to permit accessories to be attached to said sides of said body anchor, and further comprising a pair of rivets, with each of said rivets passing through an individual one of said opposed spaced openings to engage said handle, thereby pivotally mounting said handle to said body anchor between one of said opposed pairs of said spaced openings.

3. A hand climber comprising:

a chain having first and second chain ends;

a body anchor having a rectangularly shaped flat face, rectangularly shaped first and second sides, and top and bottom sides, and defining an interior space between said first and second sides thereof;

a top anchor having first and second sides and a perimeter therearound, with a hole extending through said top anchor proximate said first side thereof, and an arcuate-shaped recess extending from said perimeter into said top anchor, said chain being coupled at said first chain end to said top anchor at said hole, with said second chain end being selectively engagable to said arcuate-shaped recess to couple said second chain end to said top anchor about a vertical support pole, thereby securing said top anchor to said vertical support pole, said top anchor being fixedly secured to said top side of said body anchor such that said body anchor hangs downwardly and parallely relative to said vertical support pole;

a flat plate having a central indented recess formed therein, said recess defining a series of protruding gripper teeth terminating in a rectangularly shaped notch which separates said teeth into two laterally spaced sets of teeth, said flat plate being secured to said flat face of said body anchor, with said teeth being operable to engage said vertical support pole to preclude translation of said hand climber along said vertical support pole;

a handle pivotally mounted between said first and second sides of said body anchor such that said handle is pivotable between a first position wherein said handle is stored within said body anchor, and a second position wherein said handle is oriented orthogonal to said body anchor;

wherein said body anchor has a series of evenly spaced openings along both said first and second sides thereof, said spaced openings being arranged in opposed pairs and operable to permit accessories to be attached to said sides of said body anchor, and further comprising a pair of rivets, with each of said rivets passing through an individual one of said opposed spaced openings to engage said handle, thereby pivotally mounting said handle to said body anchor between one of said opposed pairs of said spaced openings;

wherein said handle comprises a pair of spaced, flat plates joined together by spaced first and second tubes which are rigidly attached to inside surfaces of said flat plates and extend therebetween, with said first tube being operable to be utilized as a further handle when said handle is positioned in said second position.

* * * * *